US005576721A

United States Patent [19]

Hwang et al.

[11] Patent Number: 5,576,721

[45] Date of Patent: Nov. 19, 1996

[54] COMPOSITE MULTI-BEAM AND SHAPED BEAM ANTENNA SYSTEM

[75] Inventors: Yeongming Hwang, Los Altos Hills; Vito J. Jakstys, Penn Valley, both of Calif.

[73] Assignee: Space Systems/Loral, Inc., Palo Alto, Calif.

[21] Appl. No.: 342,653

[22] Filed: Nov. 21, 1994

Related U.S. Application Data

[63] Continuation of Ser. No. 41,397, Mar. 31, 1993, abandoned.

[51] Int. Cl.[6] ..... H01Q 19/06

[52] U.S. Cl. ..... 343/753; 343/781 CA; 343/781 P; 343/840; 343/909

[58] Field of Search ..... 343/753, 754, 343/755, 756, 781 R, 781 P, 781 CA, 786, 909, 840; 342/373, 374

[56] References Cited

U.S. PATENT DOCUMENTS

| | | | |
|---|---|---|---|
| 3,308,468 | 3/1967 | Hannan . | |
| 3,460,144 | 8/1969 | Hannan . | |
| 3,815,140 | 6/1974 | Buehler . | |
| 4,232,321 | 11/1980 | Ohm . | |
| 4,236,161 | 11/1980 | Ohm | 343/781 CA |
| 4,245,223 | 1/1981 | Evans . | |
| 4,250,508 | 2/1981 | Dragone | 343/781 CA |
| 4,364,052 | 12/1982 | Ohm | 343/781 P |
| 4,387,377 | 6/1983 | Kandler | 343/756 |
| 4,503,434 | 3/1985 | Luh . | |
| 4,586,051 | 4/1986 | Saitto et al. . | |
| 4,595,929 | 6/1986 | Kreutel, Jr. | 343/781 P |
| 4,652,886 | 3/1987 | Rosser et al. | 343/756 |
| 4,710,776 | 12/1987 | Roederer et al. . | |
| 4,755,826 | 7/1988 | Rao | 343/781 P |
| 4,758,842 | 7/1988 | Linhardt et al. | 343/786 |
| 4,792,813 | 12/1988 | Rosen | 343/781 P |
| 4,811,029 | 3/1989 | Nomoto et al. | 343/781 P |
| 4,814,775 | 3/1989 | Raab et al. | 342/373 |
| 4,855,751 | 8/1989 | Ingerson . | |
| 4,972,199 | 11/1990 | Raghavan et al. | 343/756 |
| 5,258,768 | 11/1993 | Smith | 343/786 |

*Primary Examiner*—Donald T. Hajec
*Assistant Examiner*—Tan Ho
*Attorney, Agent, or Firm*—Perman & Green

[57] ABSTRACT

A composite antenna for use in satellite communication provides both the functions of multiple beams and a shaped beam radiated from a single radiating aperture. The radiating aperture may employ a mirror or a lens. Transmitted radiation from an array of radiators is coupled via a subreflector to the main reflector or lens which constitutes the radiating aperture of the antenna system. During reception of radiant-energy signals, signals received by the main reflector or lens are coupled via a separate subreflector to a separate array of receiving radiators operated at a frequency band different from that of the transmit array. The two subreflectors are combined into a single subreflector assembly employing a metallic concave reflector covered by a layer or coating of frequency selective optical material which allows for propagation of radiation at one frequency to the metal reflector while reflecting radiation in the other frequency band from a surface of the coating. Separate beamformers are employed for receiving and transmitting radiant-energy signals, the beamformers combining signals of clusters of radiators to provide for multiple beams wherein each of a plurality of the beams is formed by a cluster of radiators. Additional connection is provided via diplexers to the beamformers to select radiators to be employed for generation of shaped beams for both reception and transmission. The reflecting surfaces have diameters much larger than the diameters of the radiators to provide for individual beams from each of the radiators.

23 Claims, 7 Drawing Sheets

COMPOSITE MULTI-BEAM AND SHAPED BEAM ANTENNA SYSTEM

This is a continuation of application Ser. No. 08/041,397 filed on Mar. 31, 1993 now abandoned.

BACKGROUND OF THE INVENTION

This invention relates to the transmission and reception of signals via satellite and, more particularly, to the use of an antenna system for illuminating a specifically shaped region of earth terrain by either multiple beams or by a shaped beam from a common antenna borne by the satellite.

Satellite communication is often employed for transmission of a signal from one point on the earth's surface to be received at another point or over a specific region of the earth's surface. To accomplish this mission, it has been the practice to employ two antennas of two communication systems carried by a single satellite in synchronous orbit. The first system is a multi-beam TDMA (time division multiplex antenna) satellite communications system which is an effective way for increasing earth station power flux density by providing a high gain, narrow beam, spacecraft antenna. Increased signal power flux density allows increased transmission capacity and a smaller and more economical earth stations. On the other hand, the second system is a shaped beam FDMA (frequency division multiplex antenna) satellite communication system which is efficient for a large number of accesses to earth stations. Conventionally, to implement the two systems, two separate antennas are used, one antenna providing a multi-beam link and the second antenna providing the shaped beam link. Each antenna is a reflector antenna.

A problem arises in that the two reflector antennas needed for service take up a large part of the satellite and, therefore, may exclude the possibility of placing on the satellite additional antennas which might be required for further frequency bands of operation. Thus there is a need for reduction of the overall space required for accomplishing the two antenna functions.

SUMMARY OF THE INVENTION

The aforementioned problem is overcome and other advantages are provided by a composite antenna providing both the functions of multiple beams and a shaped beam radiated from a single radiating or optical aperture. The radiating aperture may be either a lens or a reflector, and may be part of either a single or dual optic antenna system. In a preferred embodiment of the invention, the antenna is constructed as a Gregorian antenna system with a single main reflector forming a common radiating aperture for both the functions of the multiple beams and the shaped beam. Two separate assemblies of radiating or feed elements illuminate the main reflector via a subreflector assembly composed of two surfaces for reflecting radiation at two different frequency bands. In the subreflector assembly, one of the surfaces is in the form of a layer or coating of frequency dispersive optical material disposed on the second of the reflecting surfaces, the coating being transmissive to radiation in a higher of the two frequency bands while reflecting radiation at a lower of the two frequency bands. The second reflecting surface is a metallic reflector which reflects radiation at the higher frequency band. A first of the radiator assemblies is operative at the lower frequency band, and the second of the radiator assemblies is operative at the higher frequency band. Each of the radiator assemblies includes a first array of radiating elements and a first beamformer for forming multiple beams, and a second array of radiating elements and a second beamformer for forming a shaped beam. By use of the two radiator assemblies operative at different frequency bands, the antenna system can transmit and receive simultaneously, the transmission being done at one frequency band, typically the lower frequency band, and the reception being done at a second frequency band, typically the upper frequency band.

In accordance with a feature of the invention, the number of feed elements and the arrangement of the feed elements in an array is determined by the size and shape of the region of the earth's surface to be illuminated, and is dependent also on the number of beams and on the antenna gain required to cover the region of the earth's surface, as well as on the requisite isolation between beams. The isolation between the multiple beams and the shaped beam system is achieved by a feed network with preselected filters, and includes guard bands between frequencies employed for the shaped beam and for the multiple beam situations. A low loss shared feed circuit is employed to improve spatial roll-off of each spot beam and to increase the antenna gain.

BRIEF OF THE DRAWING

The aforementioned aspects and other features of the invention are explained in the following description, taken in connection with the accompanying drawing wherein.

DETAILED DESCRIPTION

Figure 1:
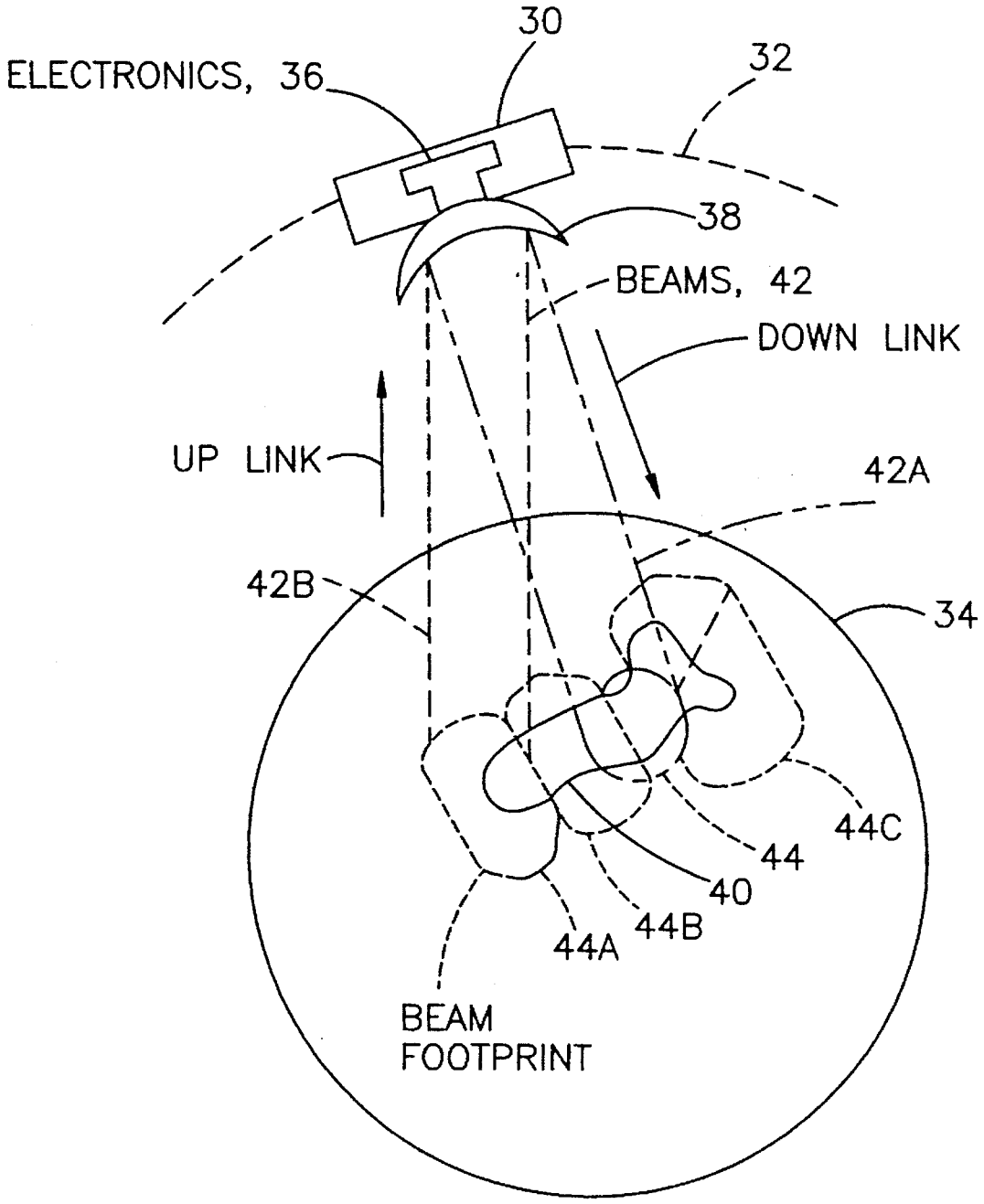
FIG. 1 is a stylized view of a satellite in a geosynchronous orbit about the earth and carrying an antenna system of the invention for use in a satellite communication link.

FIG. 1 shows a satellite 30 stationary in a geosynchronous orbit 32 above the earth 34. The satellite 30 carries electronics communication equipment 36 connecting with an antenna system 38 which serves, in accordance with the invention, for receiving uplink signals transmitted from stations on the earth, and for transmitting downlink signals to receiving stations on the earth. Communication with a region of the earth, such as a subject 40 portrayed as a land mass, requires illumination of the subject by means of a shaped-beam with a footprint having the general configuration of the subject 40 or, alternatively, by means of a set of multiple beams which are excited sequentially for successive illumination of various portions of the subject 40 wherein each of the multiple beams has a footprint covering a portion of the subject. By way of example, FIG. 1 shows a plurality of beams 42 of a set of multiple beams wherein one of the beams 42A (indicated in dot-dash lines) has a footprint 44 which covers a portion of the subject 40. Other footprints, 44A–C provide coverage of other portions of the subject 40. The footprints 44–44C overlap in their coverage at their respective interfaces with each other. Each of the footprints 44–44C is associated with a specific beam 42 such as, for example, a beam 42B illuminating the region of the footprint 44A.

Figure 2:
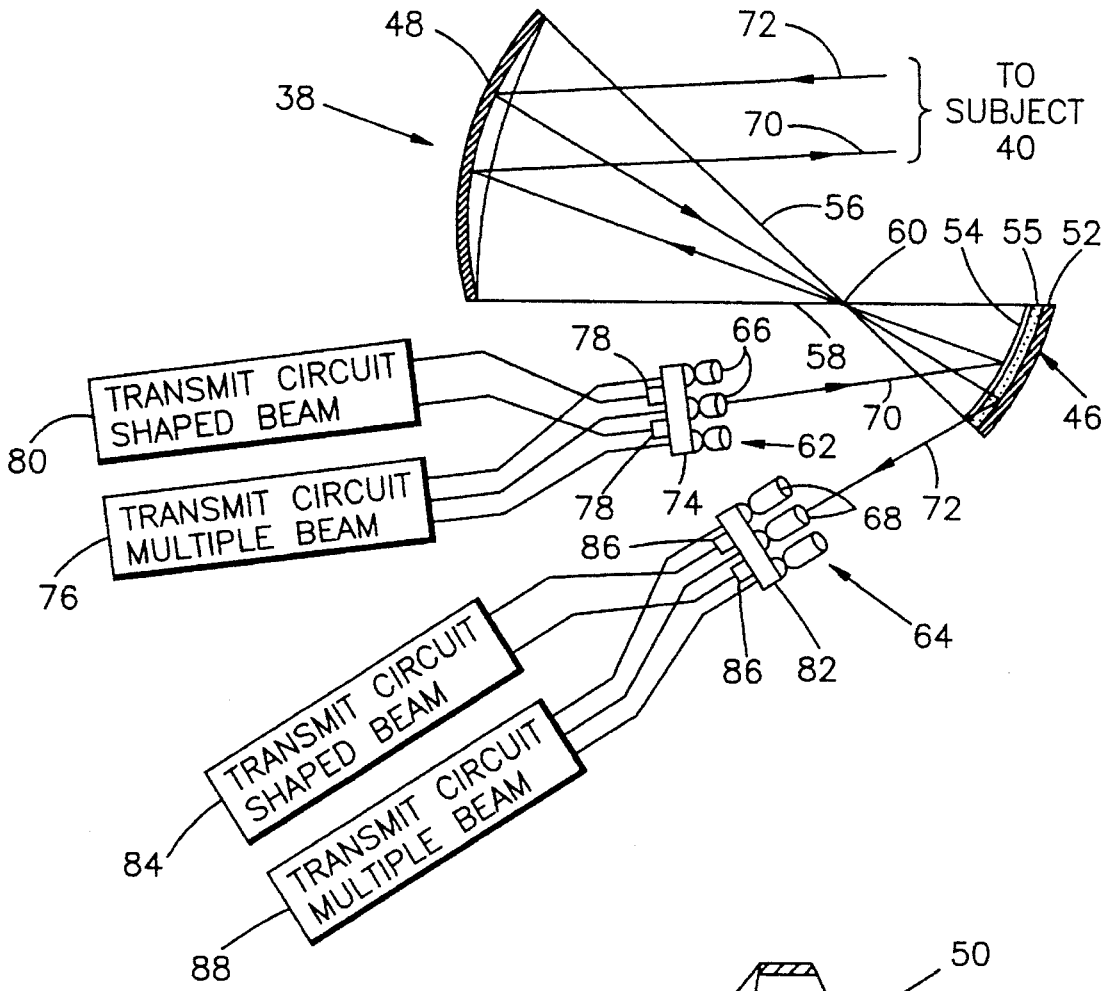
FIG. 2 is a diagrammatic view of optical and electromagnetic components of the antenna system with optical elements thereof being shown in section.

FIG. 2 shows construction of the antenna system 38 wherein, in accordance with the invention, the antenna system 38 is capable of transmitting and receiving radiant energy signals concurrently in separate frequency bands, one frequency band being employed for reception and the other frequency band being employed for transmission and, wherein, in each of the frequency bands, the antenna system 38 is capable of providing either a shaped-beam illumination of the subject 40 (FIG. 1) or multiple beam illumination of the subject 40. The antenna system 38 comprises two optical elements of which a first element is a subreflector assembly 46 and the second optical element may be either a mirror 48, as shown in FIG. 2, or a lens 50 as shown in an alternative embodiment of FIG. 3. In both embodiments of the invention, the subreflector assembly 46 is a composite of two reflecting surfaces of which one reflecting surface is provided by a concave mirror 52 and the second reflecting surface is provided by a layer 54 which is transparent to radiation at a relatively high frequency, such as 30 gigahertz (GHz) while being reflective to radiation at a lower frequency such as 20 GHz. The layer 54 has a concave reflecting surface which is slightly offset from the concave reflecting surface of the mirror 52. The subreflector assembly 46 may be fabricated of a honeycomb sandwich structure composed of a front metallic layer, namely the layer 54, and a back metallic layer, namely the mirror 52, disposed on a dielectric honeycomb core 55 wherein the front metallic layer is etched by photolithography to form a well-known array of crossed-dipole parasitic radiators or other suitable radiator configuration tuned to reflect radiation in a specific frequency range while transmitting radiation outside the frequency range to the back metallic layer. The mirror 48 has a concave reflecting surface which faces the concave reflecting surface of the mirror 52. The subreflector assembly 46 is located at a position displaced from a central axis of the mirror 48, and forms with the mirror 48 a Gregorian antenna of which the mirror 48 is the main mirror, and the mirror 52 is the subreflector at the higher frequency band while the reflecting surface of the layer 54 is the subreflector at the lower frequency band. The construction of Gregorian optical systems is well known and, accordingly, a mathematical description of the generation of the beam and the subreflector reflecting surfaces need not be provided herein. Two extreme rays 56 and 58 propagating between the mirrors 52 and 48 intersect at point 60.

The antenna system 38 further comprises two arrays 62 and 64 of radiators, or radiating elements, facing the subreflector assembly 46. The radiator array 62 is employed for transmission of radiant energy at the lower frequency (20 GHz in a preferred embodiment of the invention), and the radiator array 64 is employed for reception of radiant energy at the higher frequency (30 GHz in the preferred embodiment of the invention). The foregoing two values of frequency are provided by way of example, it being understood that other values of a lower and a higher frequency may be employed consistent with the selection of material of the layer 54 for transmission of radiation at the higher frequency and for reflection of radiation at the lower frequency. The two radiator arrays 62 and 64 are spaced apart from each other to minimize coupling of radio-frequency (RF) signals between the two arrays 62 and 64, and are located at a point of convenience within the satellite 30 (FIG. 1) consistent with the focal lengths of the reflecting surfaces of the subreflector assembly 46 and the main mirror 48, and consistent also with the relative diameters of the reflecting surfaces of the subreflector assembly 46 and the mirror 48 as compared to the diameters of the radiators 66 of the array 62 and the radiators 68 of the array 64. By way of example, a ray 70 is shown propagating from the array 62 to the subject 40 by way of multiple reflection between the optical element of the antenna system 38 and, in similar fashion, a ray 72 is shown propagating from the subject 40 to the array 64 via multiple reflections among the optical elements of the antenna system 38.

The radiators 66 connect with a beamformer 74, the beamformer 74 connecting with a transmit circuit 76 for transmission of multiple beams of radiation. The beamformer 74 is further coupled via a set of filters 78 to a transmit circuit 80 for transmission of a shaped beam of radiation. Only two of the filters 78 are shown in FIG. 2, it being understood that more of these filters may be employed as will be described hereinafter. The circuits 76 and 80 are part of the electronic equipment 36 of FIG. 1. In similar fashion, the radiators 68 are connected via a beamformer 82 to a receive circuit 84 for reception of multiple beam radiation, there being a connection of the beamformer 82 via a set of filters 86 to a receive circuit 88 for reception of shaped-beam radiation. The circuits 84 and 88 are part of the electronics equipment 36 of FIG. 1.

In operation, the offset angulation of the reflecting surface of the layer 54 relative to the reflecting surface of the mirror 52 compensates for angulation between the beams 70 and 72 in the vicinity of their respective arrays 62 and 64 to travel as parallel rays between the main mirror 48 and the subject 40. The included angle of the subreflector assembly 46, and the diameters of the radiators 66 and 68 are chosen to produce a high gain with well defined beams emanating from respective ones of the radiators 66 and 78 to provide for multiple beam and shaped beam operation of the antenna system 38, such operation being described in Ohm, U.S. Pat. No. 4,236,161 and in Ingerson, U.S. Pat. No. 4,855,751. The beamformer 74 serves to distribute radiant energy provided by either of the transmit circuits 76 and 80 among individual ones or clusters of the radiators 66 to provide the desired configuration of beams to be transmitted to the subject 40. The beams may have a circular, elliptical or more complex cross section for producing a specifically shaped footprint of illumination upon the surface of the earth. In similar manner, the beamformer 82 works in reciprocal fashion to that of the beamformer 74 to combine radiant energy of various beams received by the array of radiators 68, wherein radiation received by the radiators 68 is applied to either of the receive circuits 84 and 86 for reception of radiant-energy signals transmitted from earth stations located within the geographical bounds of the subject 40.

Since the arrays 62 and 64 operate at different frequencies, transmission and reception of radiant-energy signals can be accomplished concurrently. The filters 78 connecting with the beamformer 74 permit a shaped beam to be generated at a frequency different from that employed in the generation of a set of multiple beams which are transmitted in sequential fashion. Similarly, the use of the filters 86 connecting with the beamformer 82 allows reception of a shaped beam at a frequency different from that of signals received via a set of sequentially formed beams of a set of multiple beams. The mirror 48 and the mirror 52 are constructed of electrically conductive (metallic) material to provide a highly reflective surface to the electromagnetic radiation. It is noted that the presentation in FIG. 2 is diagrammatic and that, in practice, the cross-sectional diameter of both the mirror 52 and the layer 54 are substantially greater than the diameter of any one of the radiators 66 or 68 to provide the requisite high gain necessary for forming individual beams for radiation for each of the radiators.

Figure 3:
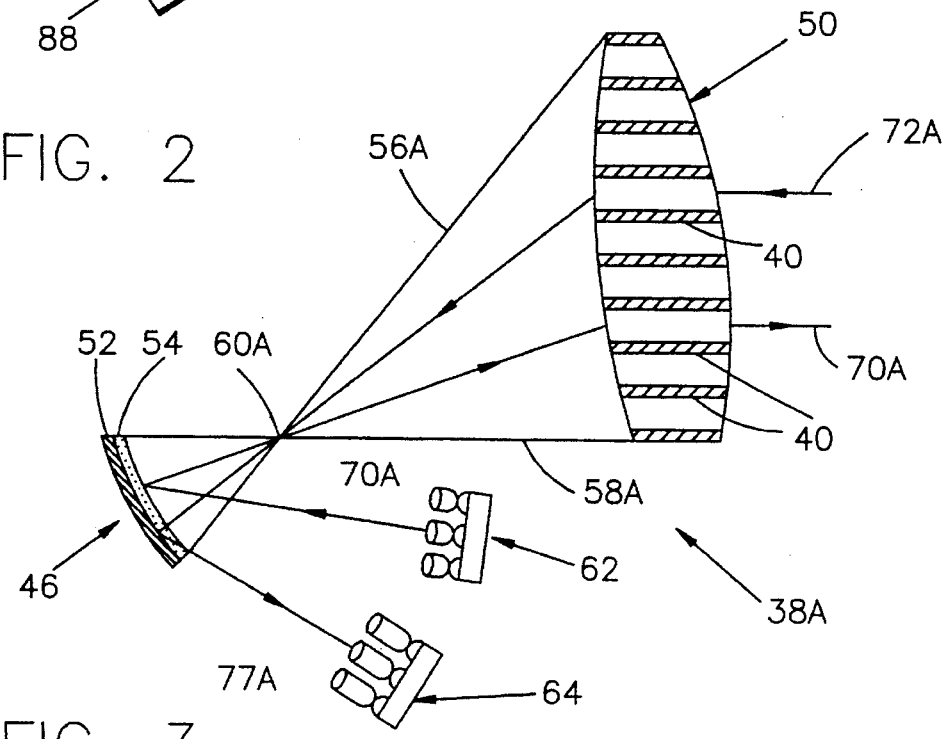
FIG. 3 is a schematic view of a portion of the system of FIG. 2 showing replacement of a primary reflector by a lens.

FIG. 3 shows the optical portion of an antenna system 38A which functions in a manner analogous to the system 38 of FIG. 2, but differs from that of FIG. 2 by substitution of the lens 50 in place of the mirror 48. The main mirror 48 (FIG. 2) serves to collimate transmitted rays and, in similar fashion, the lens 50 (FIG. 3) serves to collimate transmitted rays. FIG. 3 shows extreme rays 56A and 58A interconnecting the subreflector assembly 46 and the lens 50, the extreme rays 56A and 58A intersecting at a point 60A. The foregoing construction of the rays of FIG. 3 is similar to the correspondingly identified rays of FIG. 2. In FIG. 3, the rays 70A and 72A produced by the arrays 62 and 64, respectively, undergo reflections from the reflecting surfaces of the subreflector assembly 46, and are redirected by the lens 50 to propagate as parallel rays between the lens 50 and the subject 40. The lens 50 may be constructed from a set of parallel waveguides 90, with the waveguides 90 being of differing lengths, as shown in the cross-sectional view of the lens 50 in FIG 3.

In the system 38A, the frequency selective material of the layer 54 operates in the same fashion, as disclosed above for the system 38 of FIG. 2, to transmit radiation at the higher frequency, and to reflect radiation at the lower frequency.

Figure 4:
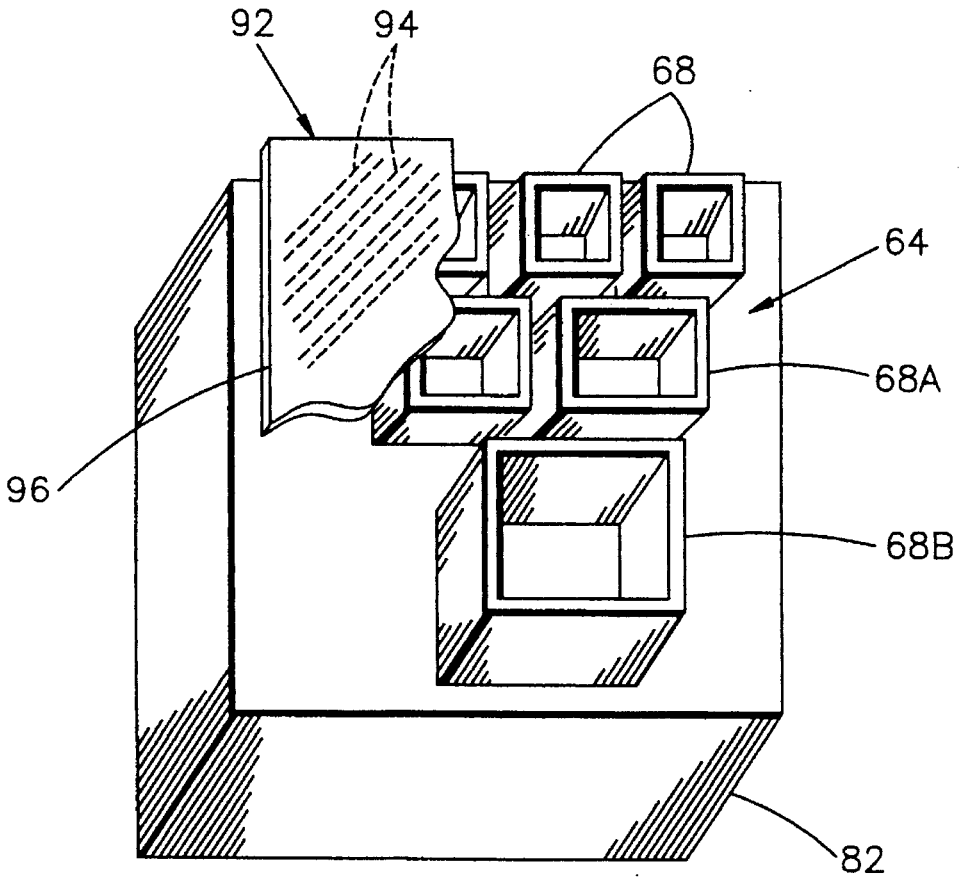
FIG. 4 is a stylized fragmentary view of a receiving array of horn radiators disposed on a beamformer, and including a meanderline polarizer in the form of a sheet, partially cut away.

FIG. 4 shows a stylized fragmentary view of the array 64 with the radiators 68 extending from the front of the beamformer 82. The radiators of the array 64 may be of the same physical size or of differing physical sizes, as will be explained hereinafter, to facilitate a shaping of the received beam of radiation, as well as to facilitate reception of individual beams of a set of multiple beams, wherein the individual beams are produced by clusters of the radiators. Accordingly, FIG. 4 shows radiators 68 of unequal size, with radiators 68A of larger cross-sectional dimensions than the radiators 68, and a further radiator 68B of still larger cross-sectional dimensions than the radiators 68A. The corresponding sides of the respective radiators 68–68B are parallel to each other. The radiators of the array 64 are configured as horns, and each is provided with a pyramidal flare. Frequently, the incoming radiation is circularly polarized, and the beamformer 82 is operative with linearly polarized radiation. Accordingly, a meanderline polarizer 92 is disposed as a sheet overlying the radiating apertures of the radiators 68–68B to convert the circularly polarized radiation to linearly polarized radiation. The polarizer 92 is configured in a well-known configuration wherein linear metallic, electrically-conductive strips 94 are embedded within a radiation transparent substrate 96 of the polarizer 92. The strips 94 are inclined at a 45 degree angle relative to the direction of the electric field of the linearly polarized electromagnetic waves propagating in the radiators 68–68B. The radiators 68–68B are shown in FIG. 4 with square cross-sections, it being understood that other cross-sectional shapes may be employed if desired, such as a rectangular or hexagonal shape, by way of example.

Figure 5:
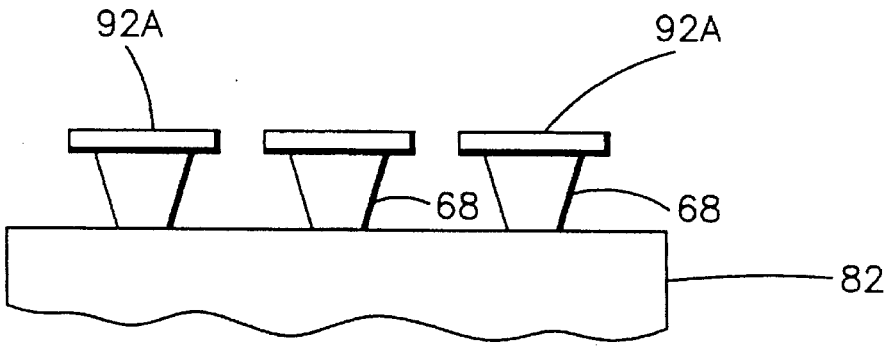
FIG. 5 shows a line of horn radiators of the array of FIG. 4, in fragmentary elevation view including separate meanderline polarizer elements for each of the horn radiators.

In FIG. 5, there is shown a stylized view of the row of radiators 68 of FIG. 4 wherein, in FIG. 5, separate meanderline polarizers 92A are disposed on the radiating apertures of respective ones of the radiators 68, this being a form of construction of the polarizer which is an alternative to the construction of the polarizer as a continuous sheet as disclosed in FIG. 4.

Figure 6:
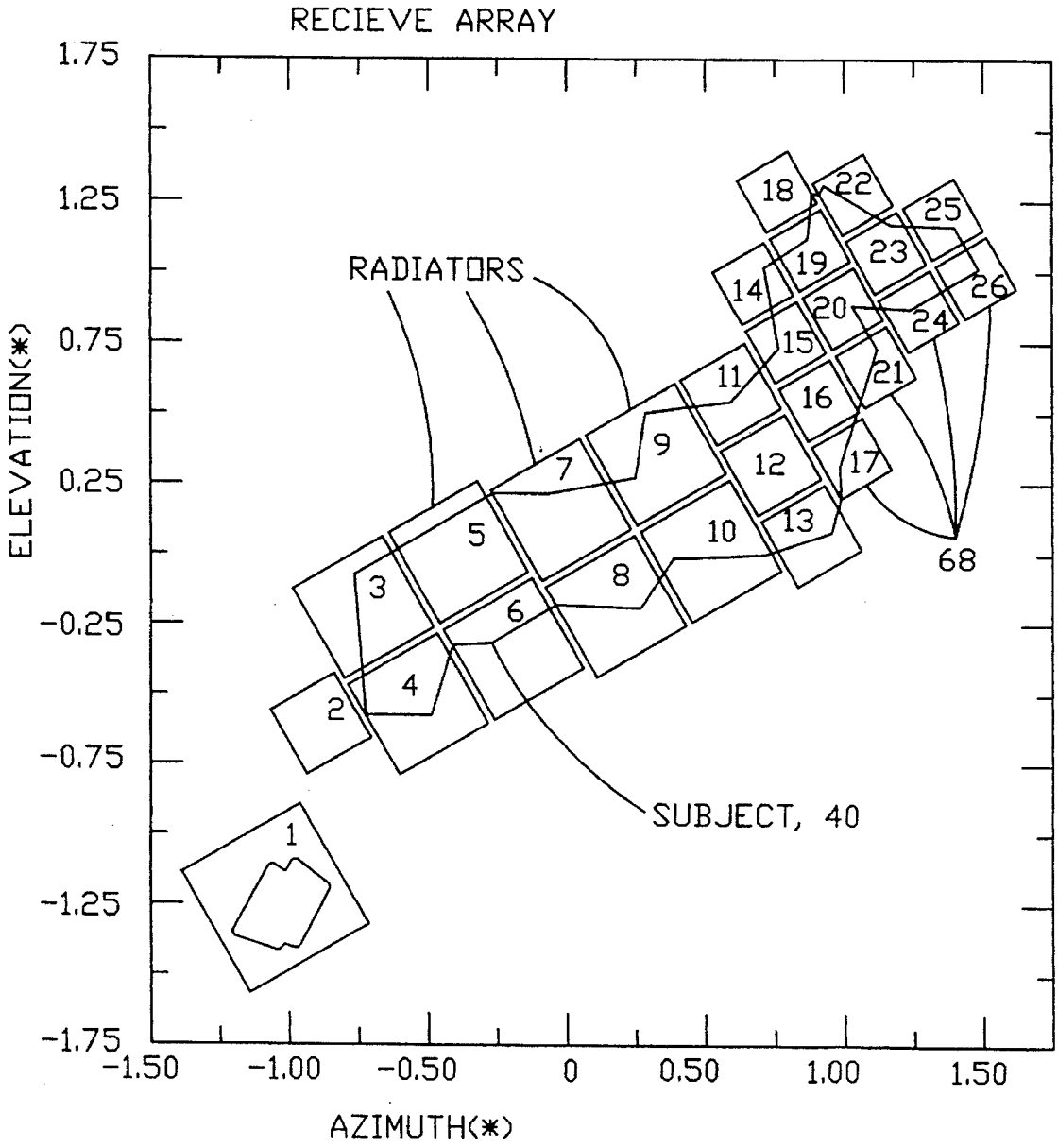
FIG. 6 is a graphical representation of an arrangement of radiators of a receiving array superposed upon the outline of a subject portion of earth's terrain to be viewed by the antenna system of FIG. 1.

FIG. 6 shows, by means of a graph, a superposition of the array of radiators 68 of the receiving array 64 upon the subject 40 of FIG. 1. For purposes of comparing the coverage of a shaped beam or multiple beams produced by the array 64 relative to the subject 40, it is presumed that the footprint 44 produced by a radiator 68 has essentially the same shape as the radiator 68 so as to provide for the graphical representation of FIG. 6 wherein the array 64 of radiators is superposed upon the subject 40. For ease of reference, the graphical presentation of FIG. 6 is described in terms of azimuth angle (the horizontal coordinate) and elevation angle (the vertical coordinate). In the upper right portion of the graph, the subject 40 has a complex boundary with rapid undulations. The undulations of the boundary of the subject 40 become more gradual in the middle of the subject 40 while, at the lower left portion of the graph, the subject boundary is relatively smooth.

It is noted that the array 64 of radiators produces beams which are stationary relative to the antenna system 38 and that, therefore, the radiators may have cross-sectional dimensions which may be as large as a wavelength or even as large as multiple wavelengths of the radiation since the beams do not have to be steered but, rather, are always directed in the same direction from the radiator array. To improve efficiency of operation and reduce complexity of the equipment, it is advantageous to vary the sizes of the radiators such that the radiators of smaller cross-section are located in the upper right corner of the array in correspondence with the complex undulations of the subject 40. In the opposite corner of the array, wherein the corresponding region of the subject 40 is bounded by a boundary having relatively little undulation, radiators of larger cross section may be employed in the array 64. If the subject 40 be regarded as an island in the middle of an ocean, with a smaller island depicted in the lower left corner of FIG. 6, then a single beam produced by a single radiator of relatively large cross section may be employed for receiving signals from the small island. The array 64 has twenty-six radiators which are numbered in FIG. 6 so as to facilitate identification of the various radiators, this identification being carried forward into FIG. 7 for use in describing the beamformer 82 for producing the uplink beams of radiation.

Figure 7:
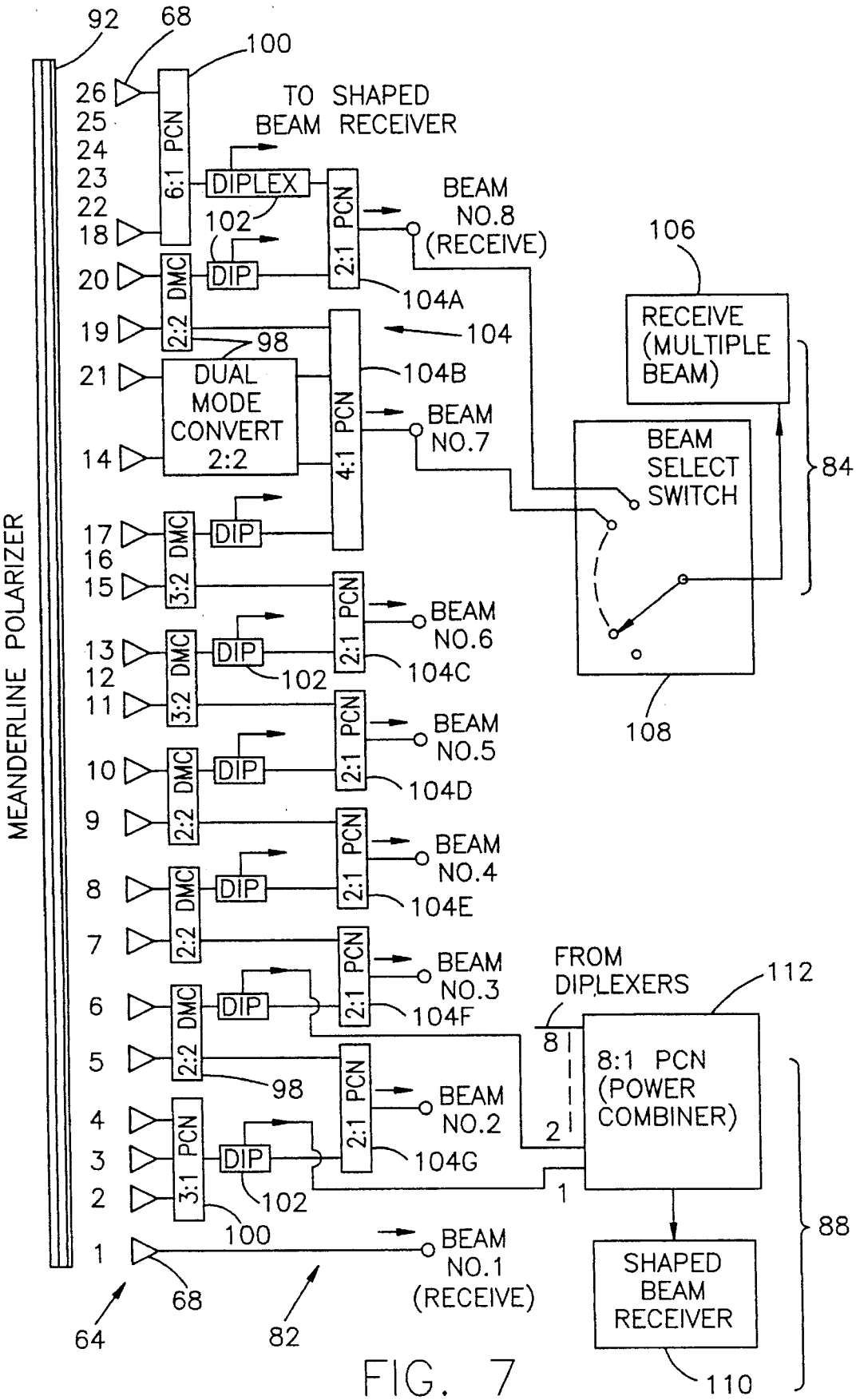
FIG. 7 is a diagrammatic view of a beamformer operative with a receiving array of radiators to form receiving beams.

FIG. 7 shows a block diagram of the receive beamformer 82, and its interconnection with the radiators 68 of the array 64 as well as with the receive circuits 84 and 88 (previously shown in FIG. 2). The twenty six radiators 68, indicated diagrammatically, face the polarizer 92, and are connected to coupling devices including both dual mode converters (DMC) 98 and power combiners (PCN) 100. Each dual mode converter 98 is constructed in the manner of a hybrid coupler and introduces a differential phase shift of 90 degrees between output terminals of the converter in the case wherein the converter has two input terminals and two output terminals. A set of three hybrid couplers are interconnected in the manner of a tree as is well known, to provide the ratio of three input terminals to two output terminals of a converter 98. With respect to the two power combiners 100, one of the combiners sums the signals of three of the radiators to provide an output signal at a single output terminal while the other of the combiners 100 is operative to sum the signals received by six of the radiators to produce a combined output signal at a single output terminal. FIG. 7 shows that the various identified radiators 68 are arranged in clusters with specific ones of the radiators being connected to specific ones of the converters 98 and combiners 100. For example, the radiators 68 identified by the numbers 18, 22, 23, 24, 25 and 26 are coupled to a single combiner 100, the output signal of the combiner 100 being coupled via a diplexer 102 to a power combiner 104 wherein the power combiner 104 is one of a further tier of combiners 104. All of the combiners 104 have a ratio of 2:1, representing a summation of two input signals to obtain one output signal, except for one of the combiners 104 which has a ratio of 4:1.

To facilitate the description of the beamformer 82, the power combiners 104 are further identified as combiners 104A–G. With respect to the radiators 68 numbered 19 and 20, received signals outputted by these radiators are combined in a converter 98 with one output signal of the converter being applied via a diplexer 102 to the combiner 104A, and the second output signal of the converter 98 being applied directly to an output terminal of the combiner 104B. Thus, the signals of nine of the radiators 68, identified by numbers 18–26, are employed in producing one of the multiple receiving beams, this beam being identified as beam No. 8 in FIG. 7. Beam No. 1 is produced directly by the single radiator 68 identified as radiator No. 1. The second receiving beam is produced by a combination of signals of the radiators 68, Nos. 2–6, wherein output signals of the radiators Nos. 2–4 are applied via a combiner 100 and a diplexer 102 to one input terminal of the combiner 104G while signals of the radiators Nos. 5 and 6 are applied to a converter 98 with one output signal thereof being applied to an input terminal of the combiner 104G. The output signals of the combiner 104G serves as a second beam of the multiple receiving beams. In similar fashion, the contributions of the various radiators to the receiving beams Nos. 3–7 are identified readily from FIG. 7.

The remaining portions of the circuitry of FIG. 7 include the multiple-beam receive circuit 84 which comprises a receiver 106 and a beam-select switch 108, such as a ferrite switch, and the shaped-beam receive circuit 88 which comprises a receiver 110 and a power combiner 112. In the operation of each of the diplexers 102, it is noted that a diplexer includes a filter which enables one of two received signals at differing frequencies to be applied directly to one of the combiners 104 while the other of the received signals at the second frequency is outputted by a second output terminal of the diplexer for coupling to the shaped beam receiver 110 via the power combiner 112. The filter functions of the diplexers 102 are represented in FIG. 2 by the filters 86. By tracing through the diagram of FIG. 7, it is noted that some, but not all, of the radiators 68 are employed in generating the shaped beam. For example, the radiators 68, numbered. 1, 14, and 21, do not participate in forming the received shaped beam. In the formation of the shaped received beam, the signals outputted via the various diplexers 102 are applied to the power combiner 112 to be combined into a signal which is applied to the receiver 110 as the signal of the shaped received beam.

With respect to the multiple beams, the signals of the eight beams are applied via the switch 108 to the multiple-beam receiver 106. The switch 108 is operative to switch sequentially from beam to beam to provide a repeating sequence of beam signals to the receiver 106. The rate of cycling through the set of beams is greater than twice the bandwidth of the beam signals, in accordance with the Nyquist criterion, to provide high quality reception of the signals of the various beams of the set of multiple beams. Suitable timing circuitry for identifying the samples of signals of the respective beams is well known, and is included within the receiver 106 to provide further processing of the signals, but need not be described in further detail for an understanding of the invention in the antenna system 38.

Figure 8:
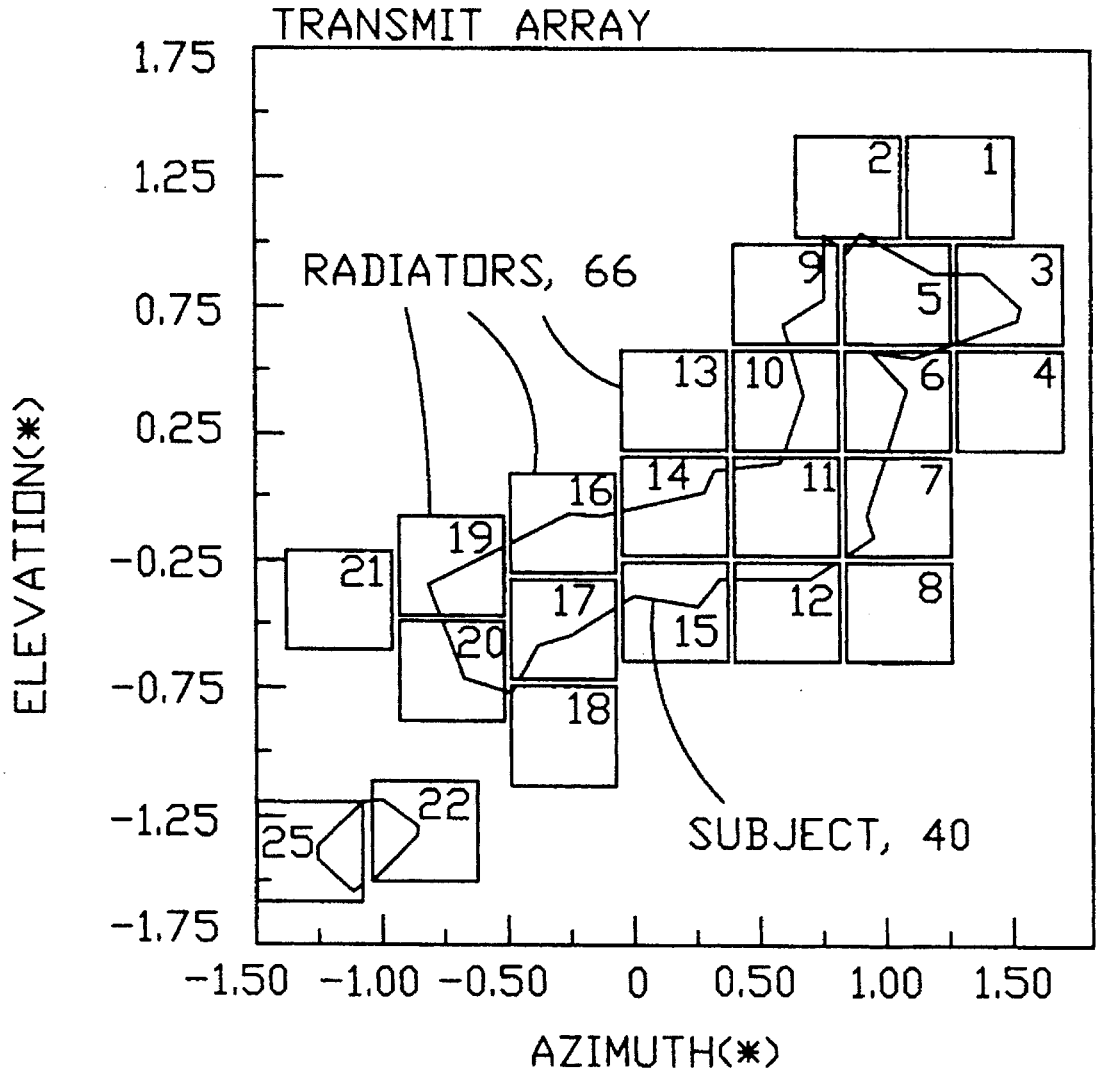
FIG. 8 is a graphical representation of an array of transmission radiators superposed upon the outline of a subject representing a portion of the earth's surface to be illuminated by the antenna system of FIG. 1.

FIG. 8 provides a diagrammatic presentation, similar to that of FIG. 6, showing a superposition of the array of radiators 66 on the transmit array 62 (FIG. 2) upon the subject 40. The radiators are arranged to follow the region enclosed by the boundary of the subject 40 so as to provide for complete coverage of the subject 40 during transmission of radiant-energy signals along the down-link to the subject 40. In comparison to the arrangement of the receive array 64 of FIG. 6, the transmit array 62 differs in that there are only 23 radiators 66, and all of the radiators 66 have the same cross-sectional dimensions. The radiators 66 are configured as horns. The radiating apertures of all of the radiators 66 are square because the configuration of the array has been found to illuminate properly the subject 40. However, for subjects of other shapes, it may be desirable to employ a different number of the radiators 66 and to provide radiators 66 having radiating apertures of differing sizes, as may be required to illuminate efficiently all areas of the subject. In FIG. 8, the individual radiators 66 are identified by numerals 1–23, the numerals appearing also in FIG. 9 to facilitate explanation of the operation of the transmit beamformer 74. The array of FIG. 8 is capable of producing both a shaped beam as well as a set of multiple beams wherein individual ones of the multiple beams may be formed by employing clusters of the radiators 66 in the generation of respective ones of the multiple beams. The number of radiators 66 is selected in accordance with the number of transmission beams and coverage to be obtained, the twenty-three radiators being sufficient for operation of the preferred embodiment of the invention in its mission of illuminating the subject 40.

Figure 9:
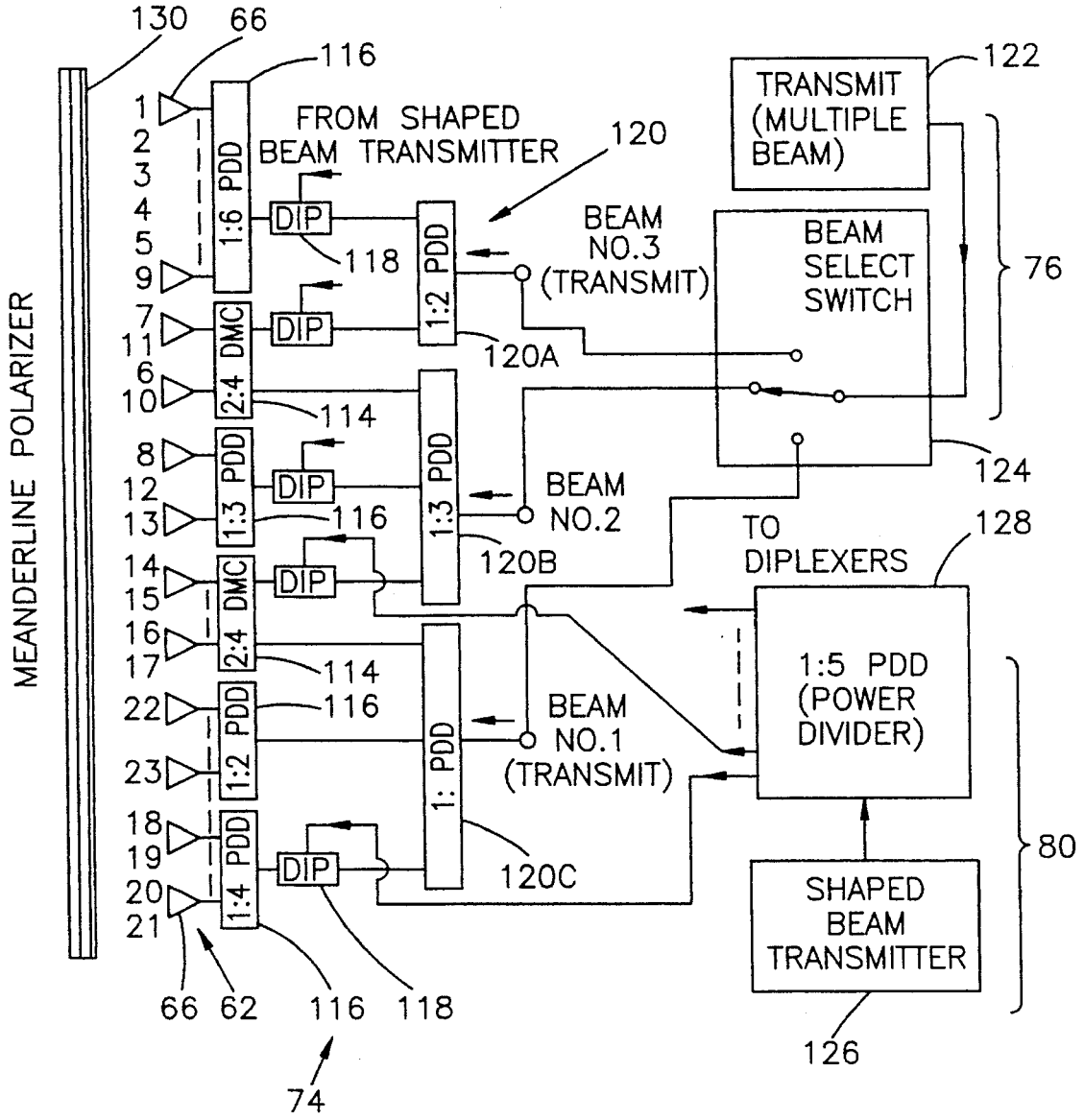
FIG. 9 is a block diagram of a beamformer operative with a transmitting array of radiators for forming transmission beams.

In FIG. 9, the arrangement of components of the beamformer 74 of the transmitted beams is similar to that of FIG. 7 for the receive beamformer, and includes a first tier of dual mode converters 114 and power dividers 116 coupled to input terminals of specific ones of the radiators identified by the numerals shown in FIG. 8. Direct connection and connection via diplexers 118 are made between input terminals of the power distribution components of the first tier, namely the converters 114 and the dividers 116, to a second tier of three power dividers 120 of which individual ones are further identified as dividers 120A–C. Also included in the circuitry of FIG. 9 are the components of the multiple-beam transmit circuit 76 and the shaped beam transmit circuit 80 (FIG. 2). The circuit 76 comprises a transmitter 122 and a beam-select switch 124, and the circuit 80 comprises a transmitter 126 and a power divider 128. A meanderline polarizer 130 is shown in front of the array of radiators 66, and has a structure similar to the polarizer disclosed in FIGS. 4 or 5, for converting linearly radiated electromagnetic waves of the radiators 66 to circularly polarized radiation.

In operation, for transmission of multiple beams, a signal produced by the transmitter 122 is applied sequentially, in a repetitive fashion via the switch 124, to each of the three beams. A first of the beams is produced with the aid of the power divider 120C having a power division ratio 1:3 for dividing a signal outputted by the switch 124 among two of the power dividers 116 and one of the converters 114 of the first tier. The second beam is produced with the aid of the power divider 120B having a ratio 1:3 for dividing the power of the signal outputted by the switch 124 among two of the converters 114 and one of the power dividers 116 of the first tier. The third beam is produced with the aid of the power divider 120A having a power division ratio 1:2 for dividing the signal power among a converter 114 and a power divider 116 of the first tier.

The converters 114 (FIG. 9) operate in similar fashion to the converters 98 (FIG. 7) by dividing input signals to output terminals to provide contributions of both input signals at each of the output terminals, as well as to introduce a quadrature phase shift between the two output terminals. Thus, both in the circuit of FIG. 7 and in the circuit of FIG. 9, there is sharing of radiators in the formations of different beams. For example, in FIG. 7, signals received by the radiators identified by the numerals 5 and 6 provide a contribution to both of the receive beams No. 2 and No. 3. In similar fashion, the four radiators of FIG. 9 identified by the numerals 14–17 are employed for generating both of the transmit beams No. 1 and No. 2. Thus, there is shared feeding of radiators of both the receive and the transmit arrays.

In FIG. 9, the transmitting radiators identified by the numerals 1–5 and 9 are energized via a single power divider 116 from one output terminal of the power divider 120A in the formation of beam No. 3. The second output terminal of the power divider 120A also provides signal power to beam No. 3 by energizing the four radiators identified by the numerals 6, 7, 10, and 11 via a converter 114 having a power division ratio of 2:4. Furthermore, in the formation of the beam No. 3, signals outputted by one of the terminals of the power divider 120B are also applied to the four transmit radiators 66 identified by the Nos. 6, 7, 10 and 11. In similar fashion, by tracing the diagram of FIG. 9, the formation of the other two beams by specific ones of the radiators 66 can be noted. In order to produce the shaped beam, a signal outputted by the transmitter 126 is applied to the power divider 128 which serves to divide power of the signals evenly among the five diplexers 118 for energization of the radiators connected to output terminals of the five diplexers 118. It is noted that all of the radiators 66 contribute to the shaped beam except for the radiators 22 and 23. For formation of both the multiple beams and the shaped beam, linearly polarized radiation applied to various radiators 66 is converted by the polarizer 130 to circularly polarized radiation. The diplexers 118 are understood to include filters, represented by the filters 78 of FIG. 2, which enable the shaped-beam signals to propagate into the radiator 66 at one carrier frequency while the signals directed to the set of multiple beams are generated at a second carrier frequency different from that of the shaped beam.

In the practice of the invention, it is contemplated that the polarizers 92 (FIG. 7) and 130 (FIG. 9) will be employed because it is customary to transmit data over satellite links via circularly polarized radiation. However, in the practice of the invention, the antenna system 38 may be employed also for linearly polarized radiation, should this be desired.

It is noted also that during transmission via the shaped beam (FIG. 9) and during reception via the shaped beam (FIG. 7) the diplexers 102 and 118 have sufficient bandwidth to allow for frequency division multiplex wherein the carrier frequency of the signal may be varied periodically at a rate twice the bandwidth of the signal so as to provide plural communication channels wherein each channel operates at a different one of the sequential frequencies. With respect to FIGS. 6–9, the lower left corner of the subject 40 is viewed by receiving beam No. 2 utilizing receive radiators 68 Nos. 2–6. Illumination of the lower left portion of the subject 40 is accomplished by transmitted beam No. 1 employing transmit radiators 66 numbered 14–23. Also, by inspection of these four figures, it is observed that the upper right portion of the subject 40 is viewed by receive beam No. 8 employing receive radiators 68 Nos. 18–26. Similarly, the upper right portion of the subject 40 is illuminated by a transmit beam No. 3 employing transmit radiators 66 Nos. 1–7 and 9–11. The viewing and illumination of other portions of the subject 40 can be noted, in similar manner, by inspection of the FIGS. 6–9.

It is to be understood that the above described embodiments of the invention are illustrative only, and that modifications thereof may occur to those skilled in the art. Accordingly, this invention is not to be limited to the embodiments disclosed herein, but is to be limited only as defined by the appended claims.

What is claimed is:

1. An antenna system comprising:

collimating means having a least one optical element;

a plurality of radiators arranged in at least one array, said one array of radiators illuminating said one optical element with radiation, said collimating means serving to form multiple beams of radiation from multiple ones of said radiators for illuminating a subject with said beams;

wherein said one optical element has a cross-sectional dimension which is much larger than cross-sectional dimensions of individual ones of said radiators for forming the beams of radiation from respective ones of said radiators, individual ones of the beams illuminating contiguous regions of the subject;

the subject has an irregular configuration with undulations, and individual ones of said radiators are positioned in said one array in a two-dimensional arrangement which conforms to the undulations in the configuration of the subject;

sizes of radiating apertures of said radiators differ wherein radiators of smaller radiating aperture are employed to illuminate a portion of the subject having a boundary with complex undulation while radiators of larger radiating aperture are employed to illuminate a portion of the subject having a boundary with gradual undulation;

cross-sectional dimensions of said radiators of smaller radiating aperture are less than a wavelength of the radiation, and cross-sectional dimensions of said radiators of larger radiating aperture are greater than a plurality of wavelengths of the radiation;

said system further comprises beam-forming means coupled to said radiators and having a network for energizing clusters of said radiators to provide multiple beams of radiation, there being a separate beam from each of said clusters, at least one of said beams from one of said clusters having an irregular two-dimensional footprint; and energizing means connecting with said network for energizing all of said clusters of radiators simultaneously to provide a shaped-beam illumination of said subject.

2. A system according to claim 1 wherein said energizing means includes filter means interconnecting said energizing means with said beam-forming means for allowing operation of said beam-forming means to produce said multiple beams at a first radiation frequency and operation of said energizing means to produce said shaped beam at a second radiation frequency different from said first frequency.

3. A system according to claim 2 wherein said network includes a plurality of dual mode converters for joining said radiators to provide said clusters.

4. A system according to claim 2 further comprising meanderline polarizing means disposed at said one array of radiators for converting linear polarization of said radiators to circularly polarized radiation during transmission of radiation from said radiators, and for converting circular polarization to linear polarization during reception of radiation at said radiators.

5. A system according to claim 4 wherein said polarizing means comprises a plurality of meanderline polarizers located at respective ones of said radiators.

6. A system according to claim 4 wherein said polarizing means comprises a common meanderline polarizer assembly extending across all of said radiators.

7. A system according to claim 6 wherein each of said radiators is configured as a horn, each horn facing said common meanderline polarizer.

8. A system according to claim 1 wherein each of said radiators is a horn having a square shaped radiating aperture, corresponding sides of the horns being parallel to provide for continuous illumination of at least a portion of the subject.

9. A system according to claim 8 wherein a ratio of diameter of horn cross section to diameter of said one optical element provides a divergence to a beam from one of said horns which overlaps partially a region of the subject illuminated by an adjacent one of said horns in said one array of radiators.

10. A system according to claim 9 wherein said network includes a plurality of dual mode converters for joining said horns to provide said clusters, and a horn at a boundary of two neighboring clusters is energized via a shared feed of electromagnetic power to radiate into the beams of both of said two neighboring clusters.

11. A system according to claim 10 wherein said network includes coupling means for joining said dual mode converters in branches of said network, said system further comprising multiplexing means for energizing said branches via time division multiplexing.

12. A system according to claim 11 wherein said coupling means comprises a power combiner for reception of radiant signals by said antenna system.

13. A system according to claim 11 wherein said coupling means comprises a power divider for transmission of radiant signals by said antenna system.

14. A system according to claim 1 wherein said network includes a plurality of coupling means for joining said radiators in branches of said network to provide said clusters, said system further comprising multiplexing means for energizing said branches via time division multiplexing.

15. A system according to claim 14 wherein said coupling means are dual mode converters.

16. A system according to claim 1 wherein said network includes a plurality of coupling means for joining said radiators in branches of said network to provide said clusters, said energizing means includes filter means interconnecting said energizing means with said branches for allowing operation of said beam-forming means to produce said multiple beams at a first radiation frequency and operation of said energizing means to produce said shaped beam at a second radiation frequency different from said first frequency, said energizing means further comprising multiplexing means for energizing said branches via frequency division multiplexing.

17. A system according to claim 1 further comprising:

a second array of radiators, and a second beam-forming means connected to the radiators of said second array of radiators;

wherein said collimating means comprises a second optical element having a larger diameter than said one optical element, said one optical element serving as a subreflector for illuminating said second optical element during transmission of electromagnetic power; and said subreflector comprises two reflecting surfaces of which one reflecting surface is operative to reflect radiation of said one array and a second reflecting surface is operative to reflect radiation of said second array.

18. A system according to claim 17 wherein said second optical element is a main reflector, and said antenna is constructed in the form of a Gregorian antenna.

19. A system according to claim 17 wherein said second optical element is a lens.

20. A system according to claim 17 wherein said one array is operative at a relatively high frequency band and said second array is operative at a relatively low frequency band, said second reflecting surface is configured as a layer of frequency selective optical material disposed on said first reflecting surface wherein said layer is transparent to radiation at said high frequency band and reflective to radiation at said low frequency band, radiation at said high frequency band propagating through said layer to reflect from said first reflecting surface.

21. A system according to claim 20 wherein said one array of radiators is operative simultaneously with said second array of radiators, said one array serving to receive radiant energy signals concurrently with a transmission of radiant energy signals from said second array.

22. A system according to claim 1 wherein at least a plurality of said radiators differ in cross-sectional dimensions from the cross-sectional dimensions of other ones of said radiators, individual ones of said radiators having smaller cross-sectional dimensions are located in positions in said one array corresponding to complex undulations of the subject, and individual ones of said radiators having larger cross-sectional dimensions are located in positions in said one array corresponding to portions of the subject having relatively little undulation, a two-dimensional footprint of a beam of one of said radiators of larger cross-sectional dimensions being larger than a two-dimensional footprint of a beam of one of said radiators of smaller cross-sectional dimensions.

23. A method for adapting an antenna system to provide a shaped-beam illumination of a subject, the subject having an irregular configuration with undulations;

wherein the antenna system comprises:

collimating means having a least one optical element;

a plurality of radiators arranged in at least one array, said one array of radiators illuminating said one optical element with radiation, said collimating means serving to form multiple beams of radiation from multiple ones of said radiators for illuminating the subject with said beams, wherein said one optical element has a cross-sectional dimension which is much larger than cross-sectional dimensions of individual ones of said radiators for forming the beams of radiation from respective ones of said radiators, individual ones of the beams illuminating contiguous regions of the subject; and beam-forming means coupled to said radiators and having a network for energizing clusters of said radiators to provide multiple beams of radiation;

wherein the method comprises steps of:

sizing the radiating apertures of respective ones of said radiators to provide radiators of smaller radiating aperture for illuminating a portion of the subject having a boundary with complex undulation, and to provide radiators of larger radiating aperture for illuminating a portion of the subject having a boundary with gradual undulation, wherein, in said sizing step, cross-sectional dimensions of said radiators of smaller radiating aperture are less than a wavelength of the radiation, and cross-sectional dimensions of said radiators of larger radiating aperture are greater than a plurality of wavelengths of the radiation;

arranging said radiators to provide that individual ones of said radiators are positioned in said one array in a two-dimensional arrangement which conforms to the undulations in the configuration of the subject; and energizing a plurality of said clusters of radiators simultaneously via said network to provide a shaped-beam illumination of said subject, there being a separate cluster beam from each of said clusters, at least one of said cluster beams from one of said clusters having an irregular two-dimensional footprint to conform to an an undulation in the configuration of the subject.

* * * * *